United States Patent [19]

Kunst et al.

[11] Patent Number: 4,717,429

[45] Date of Patent: Jan. 5, 1988

[54] PROCESS FOR THE REMOVAL OF ALKALI METAL NITRITE FROM NITRATE CONTAINING SALT BATHS

[75] Inventors: Helmut Kunst, Rodenbach; Christian Scondo, Hanau, both of Fed. Rep. of Germany

[73] Assignee: Degussa Aktiengesellschaft, Frankfurt, Fed. Rep. of Germany

[21] Appl. No.: 893,513

[22] Filed: Aug. 5, 1986

[30] Foreign Application Priority Data

Sep. 24, 1985 [DE] Fed. Rep. of Germany ..... 3533935

[51] Int. Cl.[4] ..... C21D 1/607

[52] U.S. Cl. ..... 148/15; 148/15.5; 148/128; 423/179; 423/395; 252/71

[58] Field of Search ..... 252/71; 423/395, 179, 423/184, 194, 198; 148/15, 15.5, 128; 23/293 R, 302 T, 302 A, 302 R

[56] References Cited

U.S. PATENT DOCUMENTS

| | | | |
|---|---|---|---|
| 3,793,208 | 2/1974 | Foreman | 252/71 |
| 3,966,508 | 6/1976 | Mohr | 148/15 |
| 4,158,579 | 6/1979 | Foreman et al. | 148/20 |
| 4,396,439 | 8/1983 | Foreman | 148/15 |
| 4,568,352 | 2/1986 | Fiorucci et al. | 23/293 R |

*Primary Examiner*—Christopher W. Brody

*Attorney, Agent, or Firm*—Beveridge, DeGrandi & Weilacher

[57] ABSTRACT

Undesired nitrites are formed during the treatment of salt bath nitrided structural components of iron and steel in nitrate containing cooling baths, and they must be removed from the washing water. The build-up of nitrites can be avoided by oxidizing the nitrite in the salt bath into nitrate by passing air into the cooling bath during off-times.

7 Claims, 1 Drawing Figure

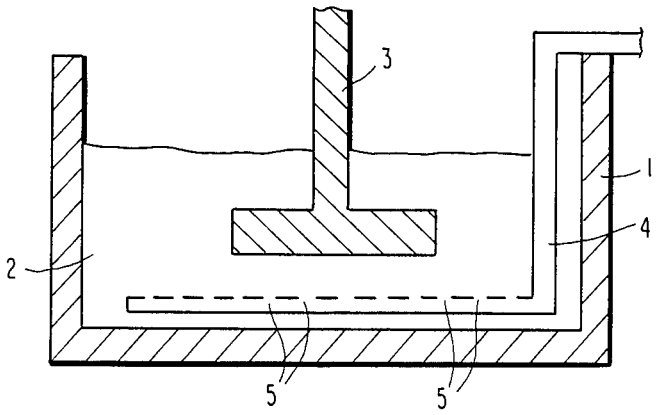
3
1
4
2
5
5

PROCESS FOR THE REMOVAL OF ALKALI METAL NITRITE FROM NITRATE CONTAINING SALT BATHS

The present invention relates to a process for the removal of alkali metal nitrites from nitrate containing salt baths used for the cooling of structural components after nitriding, and to a suitable device for carrying out the process.

In German Pat. No. 25 14 398 there is described a salt bath which is used for the cooling of iron and steel structural components that have been nitrided in a bath. The salt bath contains sodium and potassium hydroxide with approximately 10% alkali metal nitrate. This type of salt bath has come into increasing usage in the industry in order to convert into carbonates, and thereby to render harmless, the cyanide and cyanate residues addhering to the bath-nitrided components upon removal of the structural components from the nitriding bath. These salt baths have become very important since it was discovered that a significant improvement in the corrosion resistance of nitrided components could be achieved under modified treatment conditions.

During operation and utilization of these salt baths, especially at high production rates, part of the nitrate is reduced to nitrite by the conversion of cyanide and cyanate into carbonate. In practice, the workpieces that are nitrided are usually left in the cooling bath, which is operated at a temperature of 330° to 400° C., at least until they have reached the cooling bath temperature and the detoxification reaction and corrosion protection treatment have been completed. The workpieces are then removed from the cooling bath and are cooled in cold water. If the cooling bath contains nitrite, this becomes concentrated in the water that is used for cooling. Accordingly, the cooling water must also be detoxified. This additional operation can be eliminated if the nitrite formation can be suppressed or if the nitrite can be destroyed immediately after it has been formed.

Therefore, the primary object of the present invention is to provide a process for the removal of alkali metal nitrites from nitrate containing salt baths used for the cooling of structural components after nitriding operations, in order to avoid an additional detoxification operation with regard to the cooling water.

In attaining this object, a feature of the present invention resides in carrying out an oxidation in the nitriding salt bath whereby the nitrite formed therein is converted into nitrate. Preferably, this oxidation step is achieved by blowing air through the bath at intervals such as during off-times when the cooling bath is not being used for cooling of the nitrided components.

A surprising finding was that by using this simple and easy to perform technique, it is possible to oxidize the nitrite that has been formed into nitrate. The treatment of the cooling bath is carried out during off-times, e.g., at night, on weekends or in any prolonged period during which structural components are not being nitrided in the nitriding salt bath upstream of the cooling bath. Advantageously, the oxidation treatment is carried out in the shortest possible time interval in order to oxidize the nitrite being formed in the bath as early as possible at low concentrations.

This bath regeneration process is most effective if the air flows in very finely dispersed form through the salt bath. This can best be achieved with a ring-shaped, annular aeration pipe installed below the circulating agitator which is usually present in such cooling baths.

The invention is further illustrated by the drawing which represents a schematic diagram of one embodiment of an aeration device of the invention.

Described in further detail, the apparatus embodiment of the present invention comprises the annular aeration pipe (4) which is provided with holes (5) on the upper surface facing the circulating agitator (3) so that the air emerging therefrom passes directly into the surroundings of the circulating agitator (3) and is dispersed thereby into the cooling bath (2) located in a crucible (1).

Thus, it will be seen from the drawing that the aeration device is located close to; i.e. proximate, the bottom of the vessel holding the cooling salt bath. The source of oxygen (oxygen containing gas such as air or oxygen enriched air) is bubbled up from the bottom of the vessel into the area of the vessel where the agitation means, such as an impellor, distributes the bubbles of gas in a uniform manner throughout the bath to ensure good contact with the contents of the bath.

It follows that the required quantity of air to achieve the desired oxidation depends primarily on the amount of nitrite formed and thus on the quantity of nitriding salt charged into the cooling bath and, ultimately, on the size, shape and quantity of the treated structural components.

Theoretically, the air required to carry out the necessary oxidation is about 1625 liters per kg of sodium nitrite to be oxidized. Using the device described herein, an efficiency factor of 60 to 80% is achieved, so that in practice 2000 to 2700 liters of air are needed per kg of sodium nitrite.

The method can be carried out by initialing determining the composition of the cooling salt bath before any cooling operations are carried out; that is, before any nitrided iron and/or steel articles are immersed therein. Thereafter, the cooling bath is utilized to perform its expected function of cooling the nitrided components. After a period of time which is determined by practice or convenience, the cooling operation is stopped and the bath analyzed to determine the amount of nitrite present. Then an amount of oxygen containing gas; e.g. air is introduced sufficient to achieve oxidation of the nitrite to nitrate. The flow rate of gas is adjusted as convenient depending on the size of the unit and the time available for carrying out the oxidation. The composition of the bath during this operation can be monitored to determine when the desired oxidation has been achieved.

A typical agitator has a rotational speed of 1400 rpm. Sufficient shearing action is needed from the agitator impellor so that the air or oxygen can be as finely divided as possible. Impellors known as turboimpellors are particularly suitable for this purpose.

It is not necessary that the aeration device extend over the entire bottom of the vessel. For example in a vessel having a bottom surface area of 1500×1200 mm, two aeration rings of about 250 mm in diameter each and two agitators can be suitably employed.

The present invention is described in further detail in the following illustrative examples:

EXAMPLE 1

In a salt bath nitriding plant, rod shaped structural components were nitrided utilizing a nitriding salt bath of conventional type carried out in two shifts. The rods were then cooled at a temperature of 370° C. The trough which contained the cooling salt bath had dimensions of 800×600×900 mm and a salt content of 900 kg with the following initial composition (wt %):

| | |
|---|---|
| NaOH | 18.4 |
| KOH | 42.5 |
| $Na_2CO_3$ | 28.3 |
| $NaNO_3$ | 10.8 |
| $NaNO_2$ | 0.0 |

After the cooling bath had been in operation for 16 hours (=2 shifts), the composition of the bath in wt % had changed as follows:

| | |
|---|---|
| NaOH | 18.2 |
| KOH | 41.8 |
| $Na_2CO_3$ | 29.2 |
| $NaNO_3$ | 10.7 |
| $NaNO_2$ | 0.1 |

The percentage concentration of sodium nitrite corresponded to an absolute quantity of 0.9 kg. Theoretically, the air required to achieve oxidation of this quantity of sodium nitrite was 1465 liters (for an efficiency factor of 100%). Since the efficiency factor was not known beforehand, twice the above quantity of air was used. Therefore, in the available time of 7 hours, 420 liters of air per hour were passed through the bath. After only 4.5 hours, continuous analytical monitoring indicated that the concentration of sodium nitrite had decreased to 0 per cent. The air efficiency factor calculated from this is 78%. At the same time as the aeration treatment, sludge was removed from the bath so that on resumption of operation the cooling bath composition in wt % was as follows:

| | |
|---|---|
| NaOH | 19.1 |
| KOH | 42.5 |
| $Na_2CO_3$ | 27.6 |
| $NaNO_3$ | 10.8 |
| $NaNO_2$ | 0.0 |

EXAMPLE 2

Corrugated structural components were nitrided in a nitriding salt bath of conventional formulation and were then cooled in a cooling bath. The cooling trough dimensions were 1200×1700×1500 mm, the salt content was 6000 kg and the temperature was 370° C. The treatment was performed in three shift operation. The initial composition of the cooling bath and its composition after an operation time of 112 hours are set forth below:

| | Initial bath (wt %) | After 112 hours (wt %) |
|---|---|---|
| NaOH | 19.0 | 18.0 |
| KOH | 43.0 | 42.3 |
| $Na_2CO_3$ | 28.3 | 30.2 |
| $NaNO_3$ | 9.7 | 9.2 |
| $NaNO_2$ | 0.0 | 0.3 |

The absolute quantity of $NaNO_2$ formed during operation of the cooling bath was 18 kg, and the theoretical quantity of air required for oxidation was 29,250 liters. Here again, the operation was first carried out with twice the above quantity of air. However, this large cooling bath was equipped with two circulators, so the aeration was also performed through two aeration pipes. The diameter of the circles formed by the aeration pipes was about 250 mm each. Each pipe had about 25 to 30 holes with a diameter of about 3.5 mm. Air was passed through each aeration pipe at a rate of 1220 liters per hour. In this case, too, it was observed that the nitrite was fully converted after only 15 hours, which corresponds to an efficiency factor of approximately 80%. Except for minor differences, the composition of the cooling bath following aeration corresponded to the indicated initial composition.

It should be noted that the present invention can be used in combination with any conventional and known nitriding operation. A variety of iron and steel structural components and articles are subjected to nitriding using potassium cyanide and sodium cyanide as is known in the art from such sources as Kirk-Othmer, Encyclopedia of Chemical Technology, 3rd Edition, Vol. 7, pp. 322, 329; Vol. 21, page 604, which is relied on herein. The specific nature of the metal article to be treated and the specific details of nitriding baths are matters that are well understood by persons skilled in this art. Thus, the foregoing examples can be carried out following the nitriding of iron and steel articles according to known nitriding techniques as described, for example, in Kirk-Othmer.

Further variations and modifications of the invention will be apparent from the foregoing and are intended to be encompassed by the claims appended hereto.

German priority application No. P 35 33 935.7 is relied on and incorporated herein by reference.

We claim:

1. A method for the removal of alkali metal nitrites from a salt bath for cooling of nitrided iron and steel components comprising oxidizing said nitrite into the nitrate.

2. The method as set forth in claim 1, wherein an oxygen containing gas is introduced into the salt bath to oxidize sait nitrite into the nitrate.

3. The method as set forth in claim 2, wherein said gas is air.

4. The method as set forth in claim 1, wherein the bath is agitated during the oxidizing.

5. The method as set forth in claim 2, wherein said salt bath is in a holding means and said gas is introduced into the bottom of said holding means and bubbles up through said bath.

6. The method as set forth in claim 5, wherein the gas is introduced into said bath at a rate of 2000 to 2700 liters per gram of nitrite in said bath.

7. The method as set forth in claim 1, further comprising determining the composition of the salt bath before any cooling of iron and steel components takes place, after the salt bath is utilized for cooling of nitrided components for a period of time determining the composition of the salt bath, ascertaining the amount of nitrite contained in the bath, interrupting the cooling operation and treating the salt bath with an oxygen containing gas in an amount that is sufficient to oxidize the quantity of nitrite determined to be present into nitrate.

* * * * *